United States Patent [19]

Strunc

[11] 4,193,329

[45] Mar. 18, 1980

[54] PHOTOGRAPHIC PAPER CUTTER WITH DAMAGE AVOIDANCE BACK STEP MOTION

[75] Inventor: Gerald R. Strunc, Maple Grove, Minn.

[73] Assignee: Pako Corporation, Minneapolis, Minn.

[21] Appl. No.: 950,129

[22] Filed: Oct. 10, 1978

[51] Int. Cl.[2] ..... B26D 7/06

[52] U.S. Cl. ..... 83/250; 83/111; 83/235; 83/371

[58] Field of Search ..... 83/250, 235, 210, 251, 83/76, 111, 371, 202

[56] References Cited

U.S. PATENT DOCUMENTS

| | | | |
|---|---|---|---|
| 3,707,103 | 12/1972 | Tishken | 83/250 |
| 3,820,429 | 6/1974 | Harris | 83/76 |
| 4,077,287 | 3/1978 | Makeev et al. | 83/251 |
| 4,128,887 | 2/1978 | Strunc et al. | 83/371 |

*Primary Examiner*—Donald R. Schran

*Attorney, Agent, or Firm*—Kinney, Lange, Braddock, Westman and Fairbairn

[57] ABSTRACT

A strip cutting apparatus such as a photographic paper cutter senses position of the blade which cuts segments from the strip. The strip is driven in a reverse direction by a predetermined number of steps after the blade has cut the strip and before the blade is retracted. This back step motion or reverse motion eliminates the occurrence of interference between the forward edge of the strip and the blade as the blade is retracted. Damage to the forward edge of the strip caused by interference with the retracting blade is thereby avoided.

7 Claims, 8 Drawing Figures

PHOTOGRAPHIC PAPER CUTTER WITH DAMAGE AVOIDANCE BACK STEP MOTION

BACKGROUND OF THE INVENTION

1. Field of the Invention

The present invention relates to strip cutting apparatus which cuts segments from a strip. In particular, the present invention is an improvement to strip cutting apparatus such as a photographic paper cutter which includes a stepper motor for driving the strip and a movable blade for cutting the strip transversely to cut segments from the strip.

2. Description of the Prior Art

In commercial photographic processing operations, very high rates of processing must be achieved and maintained in order to operate profitably. To expedite the photographic processing, orders containing film of similar type and size are spliced together for developing. As many as 500 to 1000 rolls of 12, 20, 24, and 36 exposure film may be spliced together for processing and printing purposes.

After developing, the photographic images contained in the film negatives are printed in an edge-to-edge relationship on a continuous strip of photosensitive paper by a photographic printer. The photographic printer causes high intensity light to be passed through a negative and imaged onto the photographic paper. The photographic emulsion layer on the paper is exposed and is subsequently processed to produce a print of the image contained in the negative.

After a strip of print paper has been photoprocessed to produce prints, a photographic paper cutter cuts individual prints from the strip. The prints are then sorted by customer order and ultimately sent to the customer.

The desire for high rates of processing within commercial photographic processing operations has led to the development of extremely high speed automatic paper cutters. One example of an automatic paper cutter is the Pako PC305 paper cutter, which is capable of cutting over 25,000 prints per hour (i.e., over 7 prints per second). The following patent applications, which were all filed Sept. 29, 1977, and are assigned to Pako Corporation, the assignee of the present application, describe various portions of the Pako PC305 paper cutter: "Microprocessor Controlled Photographic Paper Cutter," Ser. No. 838,064 by G. Strunc and F. Laciak, now U.S. Pat. No. 4,128,887; "Paper Drive Mechanism for Automatic Photographic Paper Cutter," Ser. No. 837,987 by R. Diesch; "Multichannel Indicia Sensor for Automatic Photographic Paper Cutter," Ser. No. 837,986 by R. Diesch and G. Strunc, now U.S. Pat. No. 4,147,080; "Stepper Motor Control," Ser. No. 837,988 by G. Strunc; "Print and Order Totalizer for Automatic Photographic Paper Cutter," Ser. No. 838,065 by G. Strunc; "Paper Feed Control for Automatic Photographic Paper Cutter," Ser. No. 838,000 by R. Diesch and G. Strunc, now U.S. Pat. No. 4,150,711; "Photographic Paper Cutter with Automatic Paper Feed in the Event of Occasional Missing Cut Marks," Ser. No. 837,999 by G. Strunc; and "Knife Assembly for Photographic Strip Cutter," Ser. No. 837,998 by R. Diesch, now U.S. Pat. No. 4,112,801.

In order to provide the high speed and high accuracy required, most automatic photographic paper cutters use stepper motor drive systems to drive the paper strip in step increments. The digital nature of the stepper motor is particularly advantageous when used in conjunction with digital electronic controls such as a microprocessor.

SUMMARY OF THE INVENTION

The present invention is based upon the discovery that a stepper motor drive system can exhibit a slight oscillation when the strip, such as a strip of photographic paper, is brought to a stop and then cut. This oscillation, while very minute, can cause the forward edge of the strip to bind against the blade as the blade is being retracted after cutting the strip. It has been found that the oscillation problem is particularly troublesome when the round cornered photographic prints are being cut from a strip. The binding of the forward edge of the strip can cause bending or tearing of the strip.

Because the oscillation occurs when the strip has been stopped for cutting, the binding problem does not necessarily occur on each cut. This depends upon where the strip is in its particular oscillation when the blades passes through the strip. In the event that the strip is at the rearmost position of its oscillation when the knife passes through the strip, the subsequent oscillation forward of the strip will push against the blade to create the binding problem. On the other hand, if the strip is at its forwardmost position in the oscillation when the blade passes through, the strip may be retracted slightly from the blade when the blade moves upward, and no binding problem will occur. The binding problem, therefore, is erratic and unpredictable from cut to cut.

The present invention overcomes the binding problem by sensing the position of the movable blade and causing the step drive to drive the strip in the reverse direction for a predetermined number of steps after the blade has cut the strip and before the blade is retracted. This back step motion moves the paper a sufficient distance back from the blade so that there is no danger of the front edge of the strip being struck by the blade on the return motion, even if oscillation is occurring.

DETAILED DESCRIPTION OF THE PREFERRED EMBODIMENTS

Figure 1:
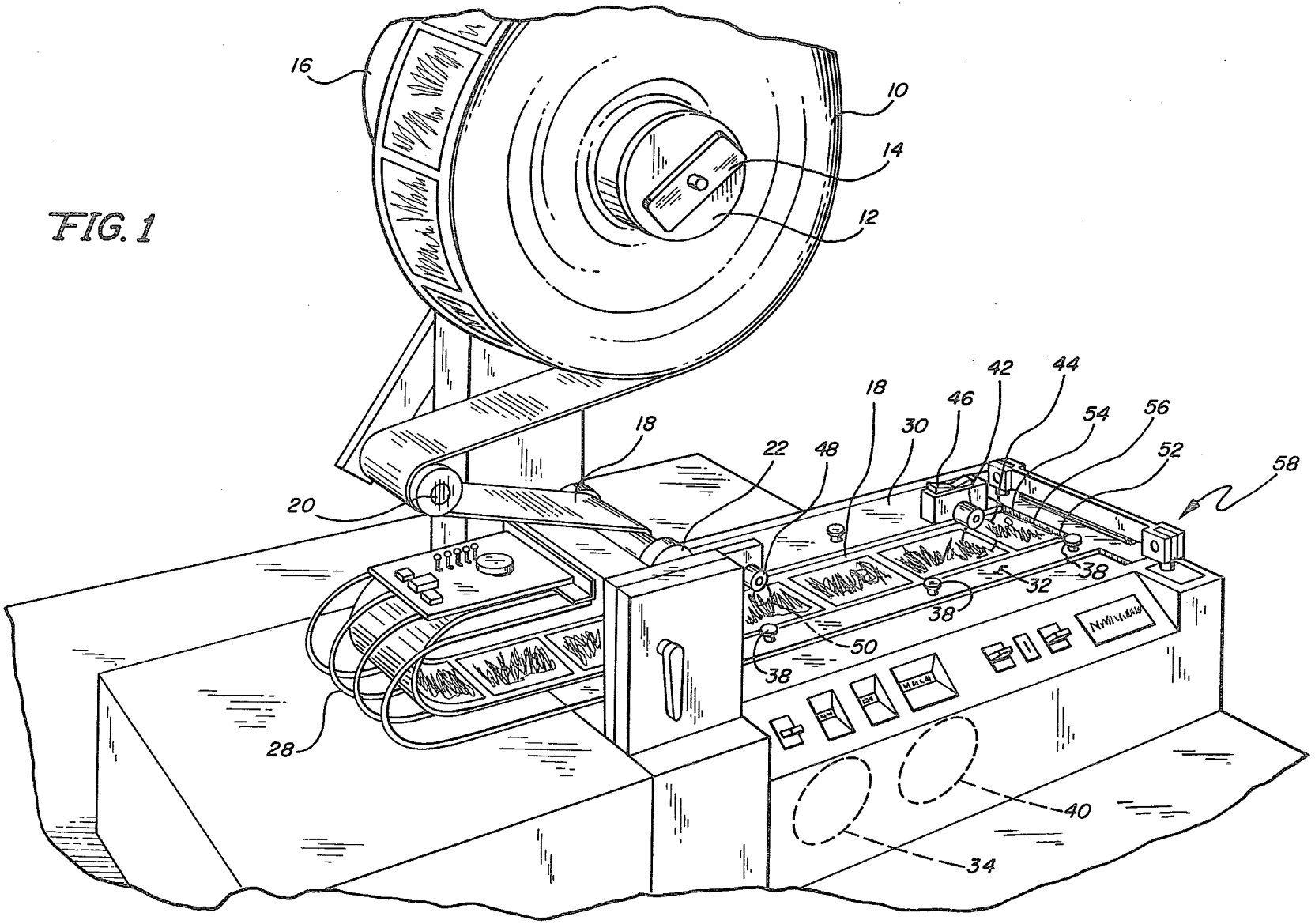
FIG. 1 is a perspective view of a photographic paper cutter which utilizes the improvement of the present invention.

FIG. 1 is a perspective view of a high speed, microprocessor controlled, automatic paper cutter which utilizes the improvement of the present invention. The paper cutter is generally described in the previously mentioned patent applications, and a detailed description of the paper cutter may be found in those previous applications.

The paper cutter of FIG. 1 includes five major portions. These portions are: (1) a paper supply, (2) a paper drive mechanism, (3) a knife assembly, (4) main and auxiliary control panels, and (5) control electronics.

The paper supply is an integral part of the paper cutter. A paper roll 10 is loaded from the front on to hub 12, and a lever 14 is tightened to hold paper roll 10 in place. By tightening lever 14, an elastomeric material is expanded to give a press fit on the inside diameter of the core of paper roll 10. The rotation of hub 12 is controlled by electro-mechanical brake 16.

Paper strip 18 from roll 10 is trained over bale arm assembly 20 and guide roller 22, between drive and idler pinch rollers (not shown), into wire form retainer 28, and then to paper guides 30 and 32 of the paper drive mechanism. The drive pinch roller is driven by the same AC motor 34 wich drives the knife assembly of the paper cutter. The motor 34 drive is transmitted to the drive pinch roller through a belt drive and electromechanical clutch 36 (shown schematically in FIG. 3).

The paper drive mechanism includes paper guides 30 and 32, which receive paper strip 18 from the paper supply assembly. Rear guide 30 is fixed and front guide 32 is movable so that various paper widths can be accommodated. Front paper guide 32 is adjusted by loosening thumbscrews 38 and moving front guide 32 to the desired position.

Paper strip 18 is driven by stepper motor 40 through idler and drive pinch rollers 42 and 44. Idler roller 42 has a lever 46 to locate idler roller 42 in the engaged position for operation and in the disengaged position for loading paper, shipping, and other non-operating modes. Rollers 42 and 44 are located at the rear edge of strip 18 so that the entire print is visible to the operator. Additional guidance of paper strip 18 is provided by another set of idler rollers 48 and 50, which are located near the end of the paper cutter.

Front and rear indicia sensor assemblies 52 and 54 are mounted below top plate 56 and sense all types of marks which appear on the back side of paper strip 18. Cut marks sensed by front or rear sensor assemblies 52 or 54 are used to indicate the location of a desired paper cut.

Figure 2:
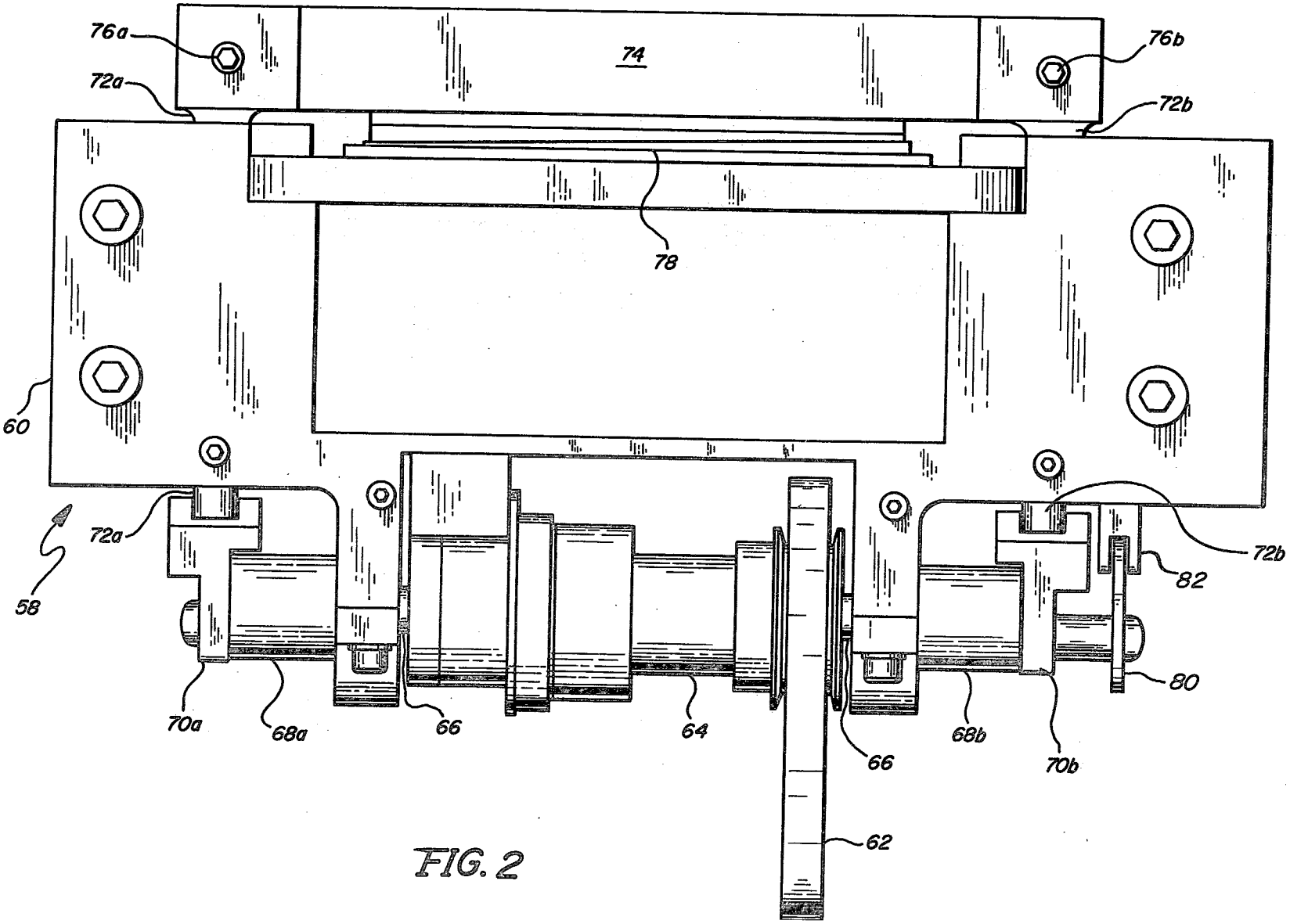
FIG. 2 is a front view of the knife assembly of the photographic paper cutter of the present invention.

Knife assembly 58 of FIG. 1 is shown in further detail in FIG. 2. A detailed description of the knife assembly 58 can be found in the previously mentioned patent application Ser. No. 837,998 by R. Diesch.

In FIG. 2, knife assembly 58 includes a base or block 60 which supports the entire knife assembly. Rotary power is supplied to the knife assembly by a timing belt 62 which is connected to AC motor 34 (not shown in FIG. 2). Timing belt 62 supplies the rotary power to spring wrap clutch 64, which is preferably a Warner CB-4 single revolution spring wrap clutch. Spring wrap clutch 64 is solenoid activated and provides a very repeatable incremental single revolution motion.

To convert the rotary motion to the linear motion required for cutting, crank shaft 66 is provided. Attached to crank shaft 66 are two end caps 68*a* and 68*b*. Caps 68*a* and 68*b* form the journals which provide the offset for the crankshaft operation. In a preferred embodiment, the offset provided by the end caps 68*a* and 68*b* is one-eighth inch, for a total displacement of one-quarter inch per revolution.

Connecting links 70*a* and 70*b* connect crank shaft end caps 68*a* and 68*b* with linear drive shafts or uprights 72*a* and 72*b*, respectively. Uprights 72*a* and 72*b* extend through linear bearings (not shown) in block 60 and are connected to movable blade 74 by connecting pins 76*a* and 76*b*.

Also shown in FIG. 2 is stationary lower blade 78. When movable blade 74 is driven downward, it cooperates with fixed lower blade 78 to cut the paper.

In one embodiment of the photographic paper cutter, there are three sets of blades: one for round cornered borderless prints, one for straight borderless prints, and one for straight bordered prints. Both the round cornered and straight borderless blade assemblies operate as a "punch and die" which punches out a slug of paper. For these assemblies, the lower fixed blade 78 is in the form of two stationary blades which form the "die" which receives the "punch" (i.e., movable blade 74).

Although the photographic paper cutter shown in FIG. 1 has been highly successful and has represented a significant advance over prior photographic paper cutters, problems with bending or tearing of the strip have occurred on occasions, particularly when round cornered photographic prints were being cut. The present invention is based upon the discovery that the stepper motor drive system of the paper cutter can exhibit a slight oscillation when strip 18 is brought to a stop and cut. Although the oscillation is quite minute, it can cause the forward edge of strip 18 to bind against movable blade 74 as blade 74 is being retracted after cutting strip 18.

As discussed previously, the binding problem occurred erratically because it depended on where strip 18 was in its oscillation when the blade 74 passed through strip 18. The binding problem occurred when strip 18 was near its rearmost position of its oscillation at the time when blade 74 passed through strip 18. The forward movement of strip 18 pushed against blade 74 and caused binding as blade 74 was being retracted.

The present invention overcomes the binding problem by sensing the position of movable blade 74. In the preferred embodiment shown in FIG. 2, the blade position sensor includes an encoder disc 80 and a sensor module 82. Disc 80 is connected to the end of end cap 68*b*, and includes two holes. The sensor module 82 includes a light source on one side of disc 80 and a light sensor on the opposite side.

One of the two holes in disc 80 is aligned so as to permit light to pass from the light source to the light sensor module 82 when blade 74 is at or near the bottom of its travel, i.e., after blade 74 has passed through strip 18. The other hole is aligned with sensor module 82 when blade 74 is back in its retracted position out of the path of strip 18.

During each cycle of actuation of the knife, the knife sensor module 82 produces two output signals. The first "KNIFE HOME" signal occurs when blade 74 has cut strip 18, and the second "KNIFE HOME" signal occurs when blade 74 has been retracted out of the path of strip 18.

The first KNIFE HOME signal is provided to the control circuitry of the cutter, when then causes stepper motor 40 to drive strip 18 in the reverse direction a predetermined number of steps. This backstep motion moves strip 18 a sufficient distance back from blade 74 so that there is no danger of the front edge of strip 18 being struck by blade 74 on the return motion, even if oscillation of strip 18 has occurred.

The second KNIFE HOME signal indicates to the paper cutter control circuitry that blade 74 is retracted out of the path of strip 18. The control circuitry then may commence another paper feed-and-cut cycle since there is no danger of blade 74 blocking the path of strip 18. In one preferred embodiment, the second KNIFE HOME signal is produced when the blade 74 is at or very near its final rest position. The second signal indicates not only that blade 74 is out of the path, but also that the knife assembly is ready to be actuated again when needed.

Figure 3:
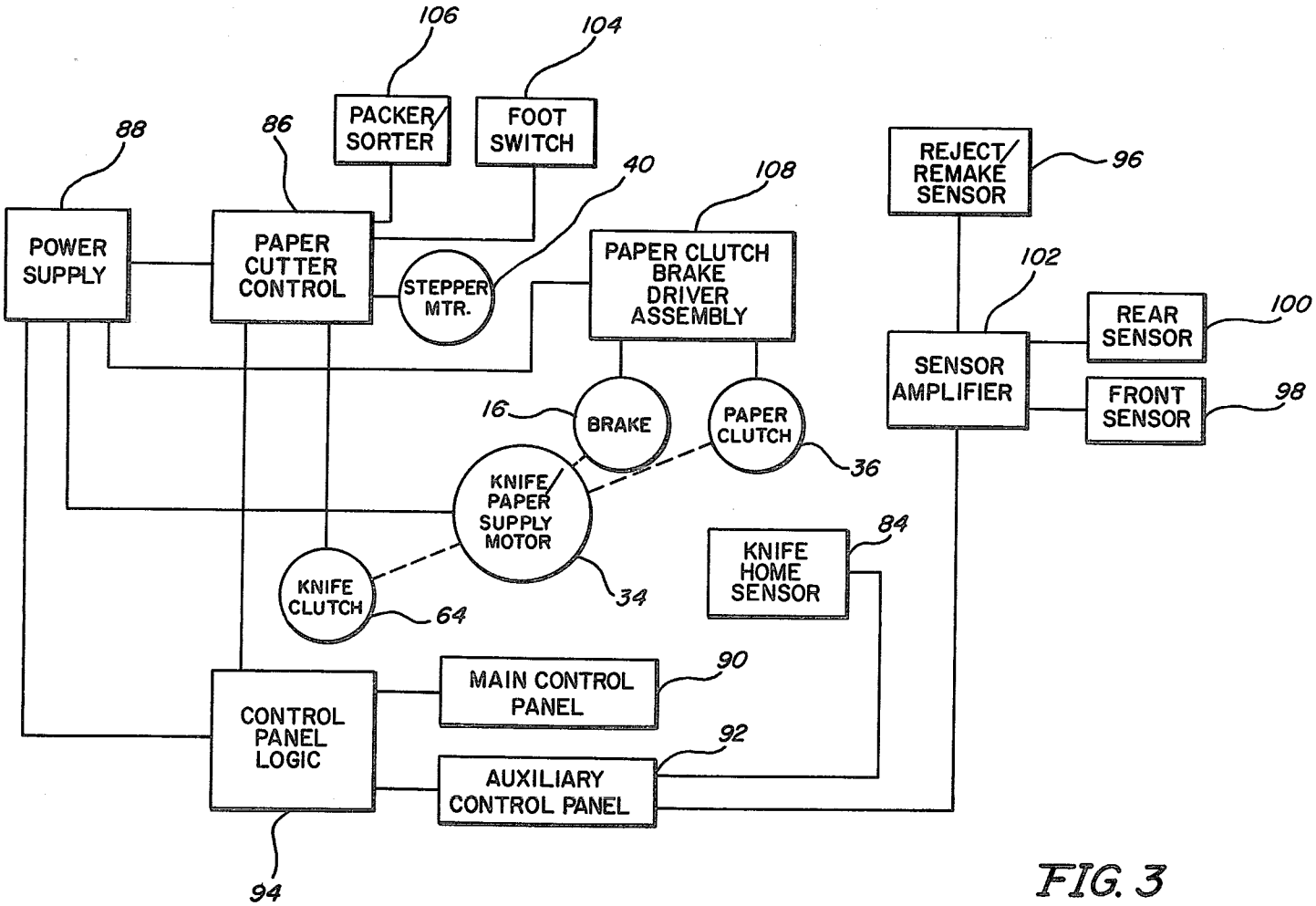
FIG. 3 is an electrical block diagram of the photographic paper cutter of the present invention.

FIG. 3 is an electrical block diagram of the photographic paper cutter which includes the improvement of the present invention. The electrical block diagram shown in FIG. 3 is generally similar to the block diagram illustrated in several of the previously mentioned patent applications, such as Ser. No. 838,064. In addition, however, the block diagram of FIG. 3 includes knife home sensor 84, which provides the first and second KNIFE HOME signals which indicate (1) that blade 74 has passed through strip 18, and (2) that blade 74 has been retracted out of the path of strip 18. The knife home sensor 84 shown in FIG. 3 includes encoder wheel 80 and sensor module 82 (shown in FIG. 2) together with suitable sensor amplifier electronics.

Paper cutter control 86 controls the operation of the paper cutter. Power for paper cutter control 86, as well as for the other various circuits and motors contained in the paper cutter, is supplied by power supply 88.

Paper cutter control 86 receives inputs from the various switches of main control panel 90 and auxiliary panel 92 through control panel logic circuit 94. In addition, signals from reject/remake sensor 96, front indicia sensor 98, and rear indicia sensor 100 are processed by sensor amplifier circuit 102 and supplied through auxiliary panel 92 and control panel logic 94 to paper cutter control 86. Similarly, in the embodiment shown in FIG. 3, the KNIFE HOME signals from knife home sensor 84 are routed through auxiliary panel 92 and control panel logic 94, although they can be routed directly to paper cutter control 86.

Paper cutter control 86 also may receive inputs from optional foot switch 104 and print packer 106. Foot switch 104 is connected in parallel with the start contacts of the start/stop switch on main control panel 90 and allows the operator to initiate a feed-and-cut cycle without the use of hands. Packer 106 may be a photographic print sorter and packer such as the PAKOMP II Photopacker manufactured by Pako Corporation. If the paper cutter is to be used in conjunction with packer 106, interconnection is necessary in order to coordinate the operation of the two devices.

The outputs of paper cutter control 86 control the operation of stepper motor 40. Control of AC motor 34 is achieved by means of knife clutch 64, paper clutch/-brake driver assembly 108, paper brake 16, and paper clutch 36. Paper cutter control 86 also supplies signals to control panel logic 94 which control a display 110 (FIG. 4) on the main control panel 90, and supplies output signals to packer 106 if the paper cutter is being used in conjunction with packer 106.

Figure 4:
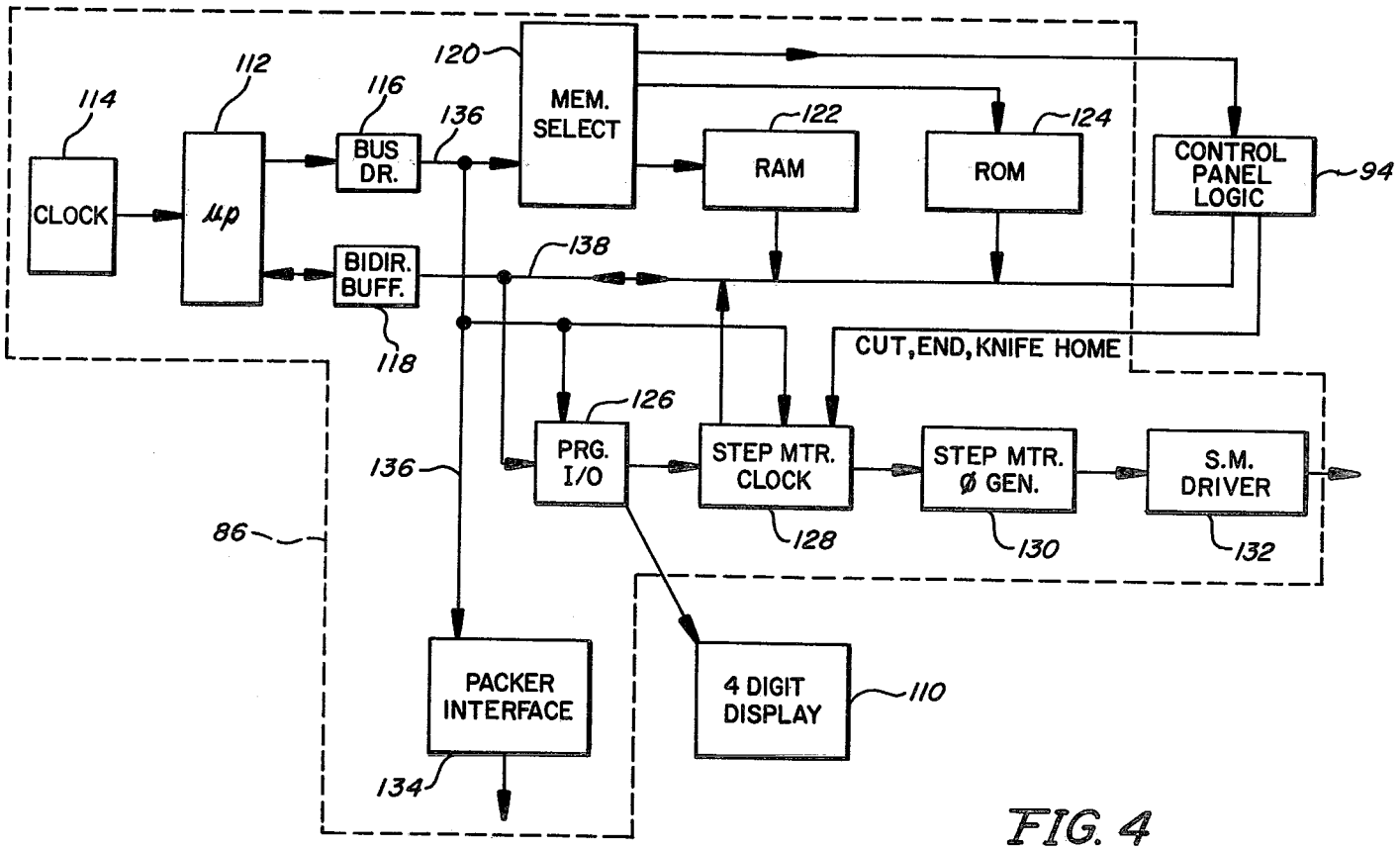
FIG. 4 is an electrical block diagram of the paper cutter control shown in FIG. 3.

FIG. 4 shows an electrical block diagram of paper cutter control 86. The paper cutter control includes microprocessor 112, clock 114, bus driver 116, bidirectional buffer 118, memory select circuit 120, random access memory (RAM) 122, read only memory (ROM) 124, programmable input/output (I/O) device 126, stepper motor clock 128, stepper motor phase generator 130, stepper motor drive 132, and packer interface circuit 134.

In one preferred embodiment, microprocessor 112 is an eight-bit microprocessor such as the Intel 8080 A. Clock circuit 114 supplies clock signals, together with some other related signals, to microprocessor 112. Bus driver 116 receives outputs from microprocessor 112 and drives various lines of address bus 136. Memory select circuit 120 receives the signals from address bus 136 and addresses selected locations of RAM 122 or ROM 124. In addition, memory select circuit 120 may address the control panel logic 94 shown in FIG. 3 to interrogate the various switches of main and auxiliary control panels 90 and 92. In the system shown in FIG. 4, the switches of main and auxiliary panels 90 and 92 are addressed in the same manner as a memory location. Data to and from RAN 122 and data from ROM 124 and control panel logic 94 is supplied over data bus 138. Bidirectional buffer 118 interconnects microprocessor 112 with data bus 138.

Programmable I/O device 126 is also connected to address bus 136 and data bus 138. Data from microprocessor 112 is used by programmable I/O device 126 to control operation of stepper motor 40 through stepper motor clock 128, stepper motor phase generator 130, and stepper motor driver 132.

Stepper motor clock circuit 128 also includes a multiplexer (not shown) in FIG. 4 which receives several signals including the CUT, END, and KNIFE HOME signals which have been routed through auxiliary control panel 92 and control panel logic 94. The multiplexer is connected to address bus 136 and data bus 138, and permits microprocessor 112 to monitor the status of the CUT, END, and KNIFE HOME signals, as well as a step status signal generated by the stepper motor clock circuitry 128. The KNIFE HOME signal is routed to the multiplexer in the stepper motor clock 128 for convenience and to avoid duplication of components, but the KNIFE HOME signal could alternatively be routed to the microprocessor 112 through another multiplexer located elsewhere in paper cutter control 86.

FIGS. 5*a* through 5*d* illustrate the operation of knife assembly 58 in accordance with the damage avoidance back step motion of the present invention. FIGS. 5*a*–5*d* show cross-sectional views of the knife assembly 58 when the round cornered borderless blade assembly is being used. As shown in FIGS. 5*a*–5*d*, the lower stationary blades 78*a* and 78*b* form a "die" which receives a "punch" (i.e., movable blade 74). The paper slug is actually punched out by the downward force of movable blade 74 and passes through an opening 140 underlying stationary blades 78*a* and 78*b*.

In FIGS. 5*a*–5*d* the knife assembly also includes stripper 142 and springs 144 and 146. Strip 18 passes over spring 144 and under stripper 142 across the gap between blades 78*a* and 78*b*, and then under spring 146.

Spring 144 lifts strip 18 slightly above blade 78*a* so that strip 18 will not hang up on the front edge of blade 78*b* if strip 18 happens to be curled.

Figure 5A:
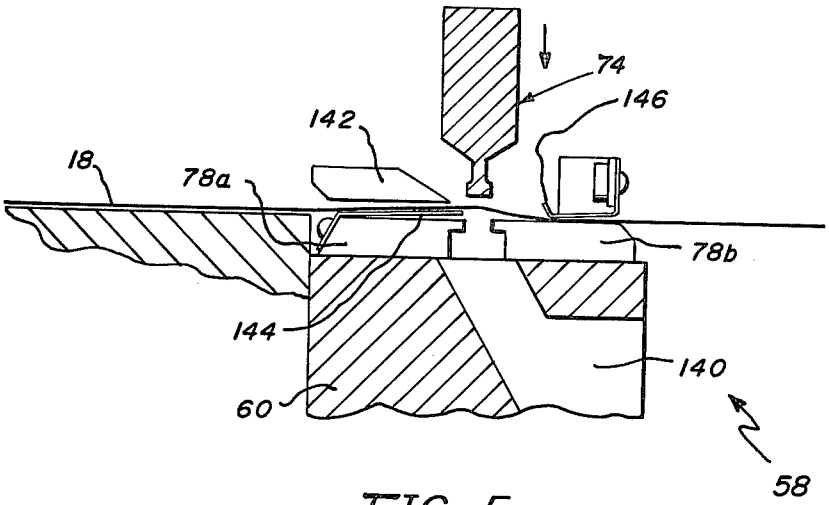
FIGS. 5*a*–5*d* are cross-sectional views of the knife assembly which illustrate the operation of the present invention.

As shown in FIG. 5*a*, strip 18 has been fed so that a substantial portion extends beyond movable blade 74. Microprocessor 112 of FIG. 4 causes strip 18 to be stopped and actuates knife clutch 64 to cause movable blade 74 to be driven downward.

Figure 5B:
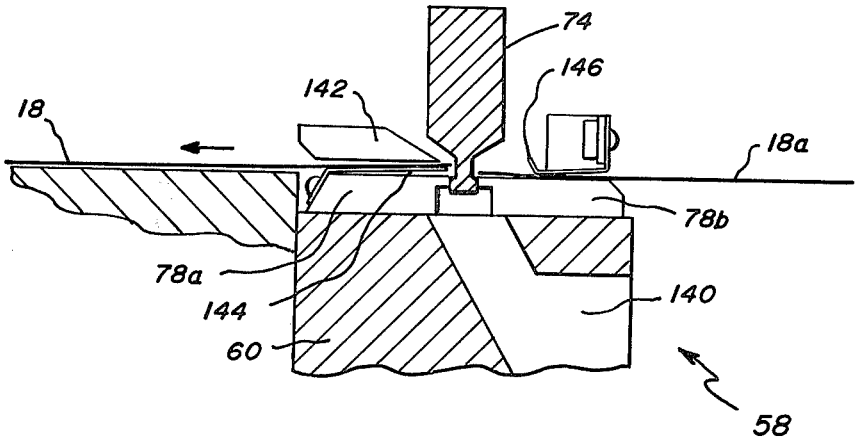

FIG. 5*b* shows the knife assembly as blade 74 has reached the bottom of its travel. A slug of paper from strip 18 has been punched out by blade 74, thereby severing print 18*a* from the remainder of strip 18.

Figure 5C:
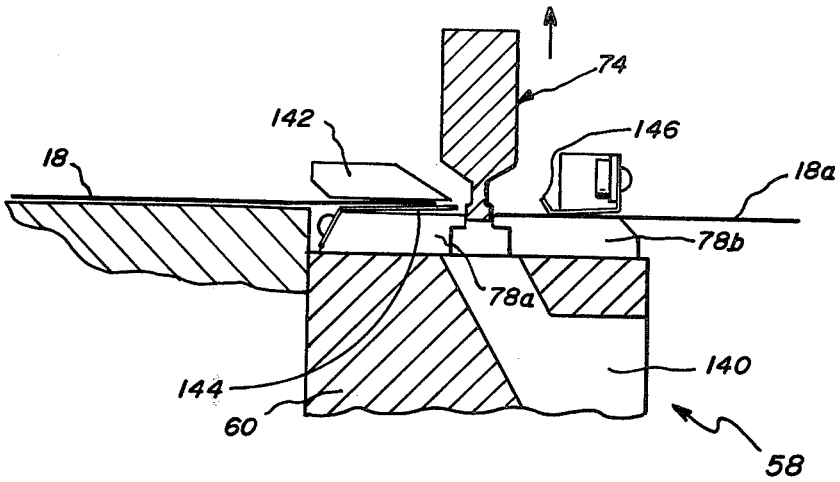

Once microprocessor 112 has actuated knife clutch 64, it then monitors the status of the KNIFE HOME signal. When the first KNIFE HOME signal is received by microprocessor 112, it indicates that blade 74 has cut print 18*a* from strip 18, but has not yet been retracted. Microprocessor 112 provides signals to the stepper motor clock 128 which causes stepper motor 40 to drive strip 18 in a reverse direction by a predetermined number of steps. In one preferred embodiemnt, the predetermined number of steps is 4, with each step representing 0.012 inch. The arrow just above strip 18 in FIG. 5*b* illustrates the reverse direction that strip 18 is driven. The back step motion of strip 18 moves the leading edge of strip 18 away from blade 74 a sufficient distance so that there is no danger of interference between blade 74 and strip 18 as blade 74 is retracted. FIG. 5*c* shows the knife assembly as blade 74 is being retracted.

Figure 5D:
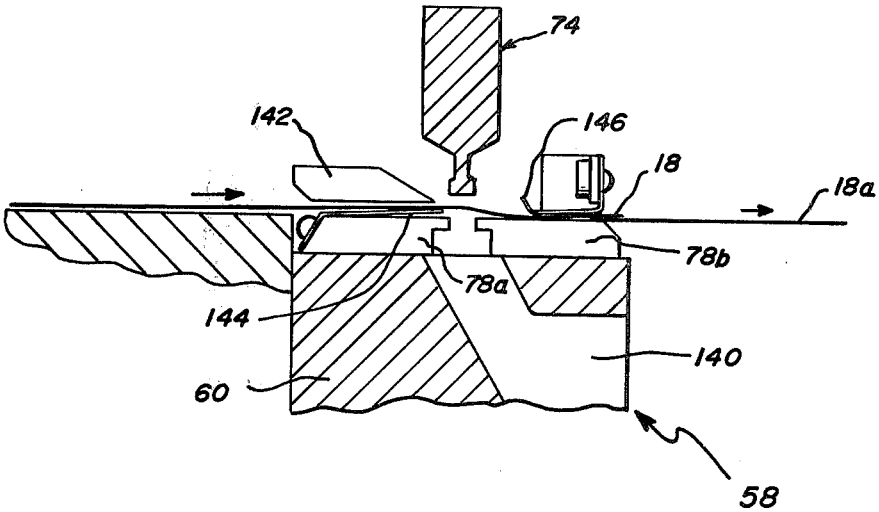

FIG. 5*d* shows the knife assembly after blade 74 has returned to its rest position out of the path of strip 18. As blade 74 reaches or approaches its rest position, knife home sensor 84 generates the second KNIFE HOME signal. This indicates to microprocessor 112 that blade 74 is out of the path of strip 18 and another feed-and-cut cycle may be commenced.

As strip 18 is again driven forward by stepper motor 40, it passes under spring 146 and rides over the top of previously cut print 18*a*. Because of the contact between strip 18 and previously cut print 18*a*, print 18*a* is forced out from under spring 146. If the paper cutter is being used without a print sorter or packer, this causes the prints to be layered as they come off the end of the cutter so as to produce a stack of prints.

In one preferred embodiment of the present invention, microprocessor 112 readjusts the feed length of the next paper feed to compensate for the reverse steps which were taken previously. This is particularly advantageous in a photographic paper cutter which uses an "electronic window" during which a cut mark must be sensed. The compensation for the reverse steps taken during the cutting operation assures that the "window" occurs during the correct portion of the next feed cycle. Similarly, if the printer is being operated in a "no cut mark" mode, the compensation for reverse steps assures that the feed length of the next feed cycle will be correct, despite the reverse steps which move the front edge of the strip away from the knife.

In conclusion, the present invention overcomes the problems of binding of strip 18 against blade 74 while blade 74 is being retracted after cutting strip 18. The present invention utilizes a sensor 84 which provides KNIFE HOME signals indicative of the position of the blade. Based upon these signals, strip 18 is driven in a reverse direction a predetermined number of steps after blade 74 has cut the strip 18 and before blade 74 is retracted. This backstep motion moves strip 18 a sufficient distance back from blade 74 so that there is no danger of the front edge of strip 18 being struck by blade 74 on the return motion.

In addition, the use of a second KNIFE HOME signal which follows the first KNIFE HOME signal and indicates that blade 74 has been retracted or has reached its rest position assures that strip 18 will not be driven forward while blade 74 is still in the path of strip 18.

Although the present invention has been described with reference to preferred embodiment, workers skilled in the art will recognize that changes may be made in form and detail without departing from the spirit and scope of the invention. For example, although the present invention has been described in terms of a particular photographic paper cutter, the present invention may also be used in conjunction with other strip cutting apparatus which uses a stepper motor type of drive system.

What is claimed is:

1. A strip cutting apparatus for cutting segments from a strip, the apparatus comprising:

step drive means for driving the strip in a stepwise manner along a path;

knife means located along the path, the knife means including a movable blade which moves downward to cut a segment from the strip and upward to retract out of the path of the strip;

blade position sensing means for sensing the position of the movable blade; and control means for receiving signals from the blade position sensing means and causing the step drive means to drive the strip in a reverse direction for a predetermined number of steps after the movable blade has cut a segment from the strip and before the movable blade is retracted.

2. The apparatus of claim 1 wherein the blade position sensing means provides a first signal indicative of the movable blade being at the bottom of its movement.

3. The apparatus of claim 2 wherein the control means causes the step drive means to drive the strip in the reverse direction after receiving the first signal.

4. The apparatus of claim 3 wherein the blade position sensing means also produces a second signal indicative of the blade having retracted to a position out of the path of the strip.

5. The apparatus of claim 4 wherein the control means permits a subsequent feed-and-cut cycle to be initiated after the second signal has been received.

6. The apparatus of claim 5 wherein the control means adjusts the number of steps to be taken in the subsequent strip feed-and-cut cycle to compensate for the predetermined number of steps which the strip was driven in the reverse direction.

7. In a strip cutting apparatus which includes step drive means for driving a strip in a stepwise manner along the path and a movable blade located along the path for cutting the strip transversely to cut a segment from the strip, the improvement comprising:

means for causing the step drive means to drive the strip in a reverse direction after the blade has cut the strip and before the blade is retracted out of the path of the strip to prevent the forward edge of the strip from interfering with the blade as the blade is retracted, said means for causing the step drive means to drive the strip in a reverse direction, comprising:

blade position sensing means for providing signals indicative of the position of the blade; and control means for receiving the signals from the blade position sensing means and causing the step drive means to drive the strip in the reverse direction for a predetermined number of steps after the blade has cut the strip and before the blade is retracted.

* * * * *